US005417415A

United States Patent [19]

Murakami

[11] Patent Number: 5,417,415

[45] Date of Patent: May 23, 1995

[54] METHOD OF STRAIGHTENING SKEW IN CUT SHEET AND APPARATUS THEREFOR

[75] Inventor: Kenjiro Murakami, Nagano, Japan

[73] Assignee: Seiko Epson Corporation, Tokyo, Japan

[21] Appl. No.: 202,197

[22] Filed: Feb. 25, 1994

[30] Foreign Application Priority Data

Feb. 25, 1993 [JP] Japan ..... 5-060989

[51] Int. Cl.[6] ..... B65H 7/02

[52] U.S. Cl. ..... 271/227; 271/10; 271/242; 271/902

[58] Field of Search ..... 271/227, 228, 242, 902, 271/10

[56] References Cited

U.S. PATENT DOCUMENTS

| | | | |
|---|---|---|---|
| 4,248,415 | 2/1981 | Steinhilber | 271/9 |
| 4,990,011 | 2/1991 | Underwood et al. . | |
| 5,051,014 | 9/1991 | Takagi et al. | 271/242 |
| 5,069,442 | 12/1991 | Storz | 271/272 |
| 5,157,449 | 10/1992 | Matsuno et al. . | |
| 5,222,724 | 6/1993 | Hirano et al. | 271/227 |
| 5,246,224 | 9/1993 | Matsuno et al. | 271/242 |

FOREIGN PATENT DOCUMENTS

| | | | |
|---|---|---|---|
| 0529538 | 8/1992 | European Pat. Off. . | |
| 62-38261 | 8/1987 | Japan | B65H 9/14 |

*Primary Examiner*—H. Grant Skaggs
*Attorney, Agent, or Firm*—Sughrue, Mion, Zinn, Macpeak & Seas

[57] ABSTRACT

A method of straightening a skew in a cut sheet according to the present invention including the steps of feeding the cut sheet toward a sheet forward roller which is rotating forwardly in a sheet forward direction by a sheet feed roller, rotating the sheet forward roller backwardly immediately after a front end of the cut sheet is nipped by the sheet forward roller, adjusting a position of the front end of the cut sheet in a direction orthogonal to the sheet forward direction by a difference between widthwise sheet nipping amounts on right and left ends of the cut sheet, and feeding the cut sheet by rotating the sheet forward roller forwardly again. An apparatus for carrying out the above-mentioned steps is also disclosed.

6 Claims, 4 Drawing Sheets

METHOD OF STRAIGHTENING SKEW IN CUT SHEET AND APPARATUS THEREFOR

BACKGROUND

The invention relates to a method of straightening a skew in a cut sheet and an apparatus to which such method is applied.

In a sheet feed unit for feeding piled cut sheets toward a print section or the like on a single sheet basis, widthwise displacement of the cut sheet at an initial stage of sheet feeding leads to skew feeding, which causes the problem of wrinkling or jamming the sheet thereafter.

To overcome this problem, an apparatus is disclosed in U.S. Pat. No. 4,248,415, which operates as follows. A sheet fed by a sheet feed roller is suspended by a pair of sheet forward rollers that are rotating backwardly on a downstream side in a sheet forward direction of the sheet feed roller, so that the position of a front end of the sheet can be corrected by reaction derived from the flexion of the sheet which is caused by such suspension. Further, an apparatus proposed in Japanese Patent Examined Publication No. 62-38261 is designed to correct the position of the front end of the sheet by utilizing reaction derived from the flexion of the sheet which is caused by discharging the sheet while reversely rotating a sheet forward roller when the front end of the sheet has been nipped by the sheet forward roller completely.

These apparatuses are simple in design in that the hardness of a sheet is utilized to correct the position of the sheet. However, both apparatuses entail much time in straightening a skew in a cut sheet because they require that the sheet be flexed. In addition, these apparatuses are not sufficiently effective in straightening the skew because the reaction is small even if the sheet is flexed in the case of a soft sheet, and because the sheet cannot be flexed at all in the case of a hard sheet.

The invention has been made in view of the above circumstances. Accordingly, the object of the invention is to provide a novel skew straightening method and a apparatus therefor, which ensure a quickest operation and which are effective, reliable, and applicable to any kind of paper, either hard or soft.

SUMMARY

To accomplish the above mentioned object, the present invention provides a method of straightening skew in a cut sheet comprising the steps of: feeding the cut sheet toward a sheet feed roller which is rotating forwardly in a sheet forward direction by a sheet feed roller; rotating the sheet forward roller backwardly immediately after a front end of the cut sheet has been nipped by the sheet forward roller; adjusting a position of the front end of the cut sheet in a direction orthogonal to the sheet forward direction by a difference between widthwise sheet nipping amounts on both right and left ends of the cut sheet; and feeding the cut sheet by rotating the sheet forward roller forwardly again.

Furthermore, the present invention provides an apparatus to which the above-mentioned steps apply.

DETAILED DESCRIPTION OF PREFERRED EMBODIMENTS

An embodiment of the invention will now be described with reference to the drawings.

Figure 1A:
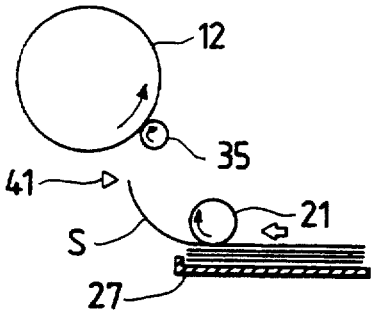
FIGS. 1(*a*) to 1(*h*) are diagrams which are useful in explaining a skew straightening method according to the present invention wherein FIGS. 1(*a*) and 1(*e*), FIGS. 1(*b*) and 1(*f*), FIGS. 1(*c*) and 1(*g*) and FIGS. 1(*d*) and 1(*h*) are side and frontal views, respectively, of various operational states of a cut sheet feed apparatus. Hereinafter, reference to any of FIGS. 1(*a*) to 1(*d*) will be understood as referencing the designated side view and its respective frontal view.
Figure 1B:
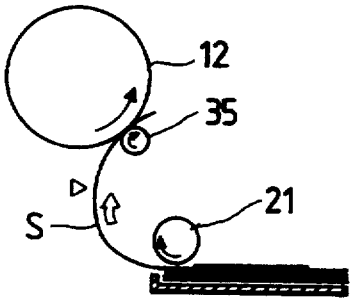
Figure 1C:
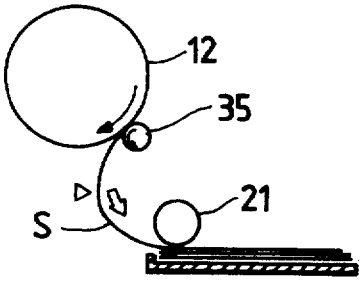
Figure 1D:
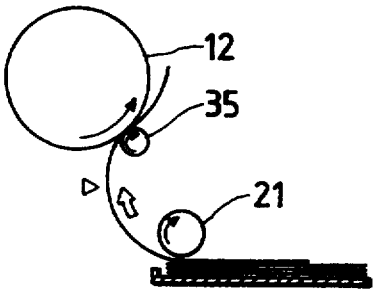
Figure 1E:
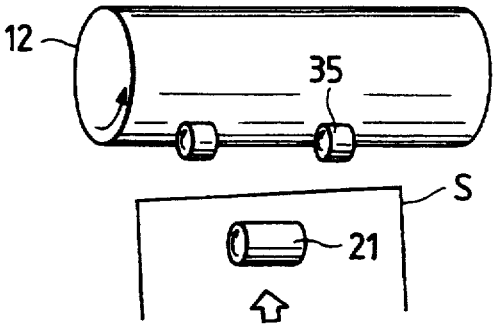
Figure 1F:
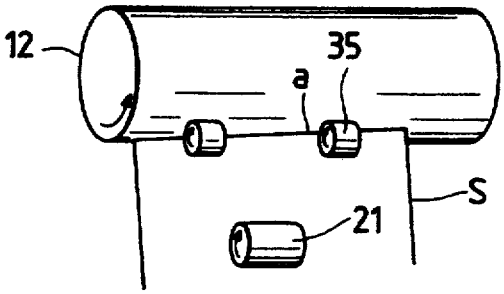
Figure 1G:
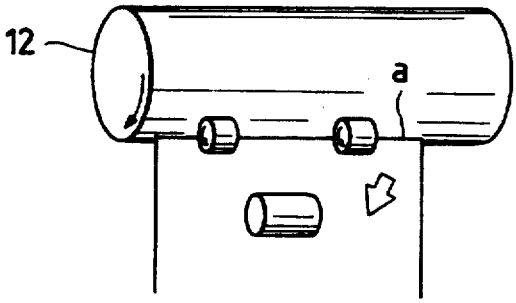
Figure 1H:
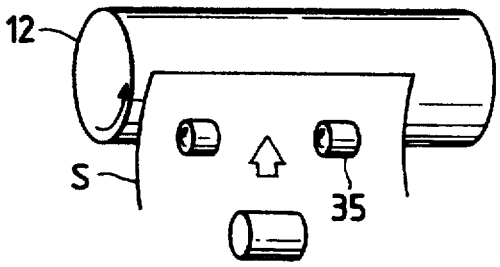
Figure 2:
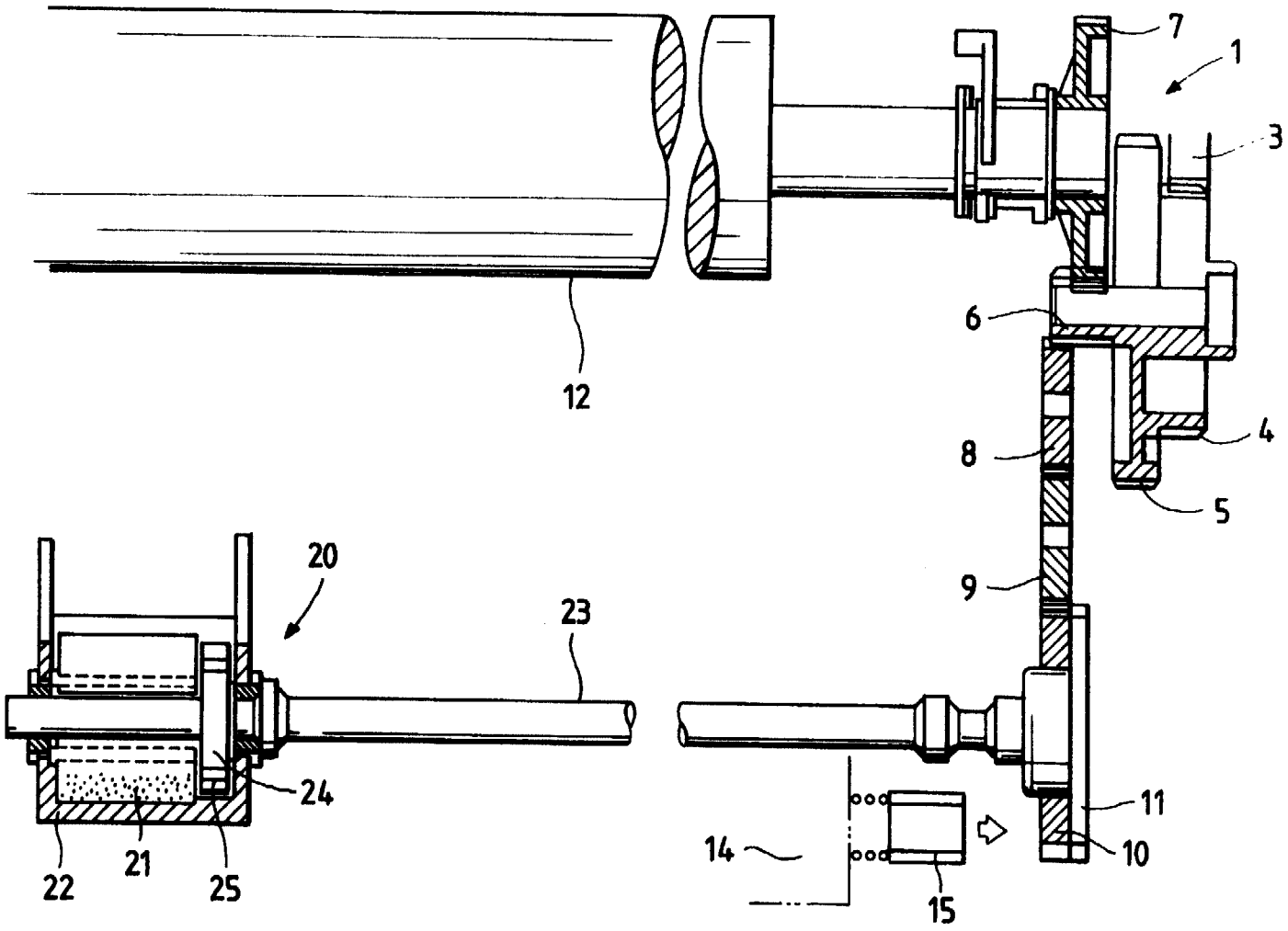
FIG. 2 is a top view showing a drive mechanism of an apparatus to which the method is applied.
Figure 3:
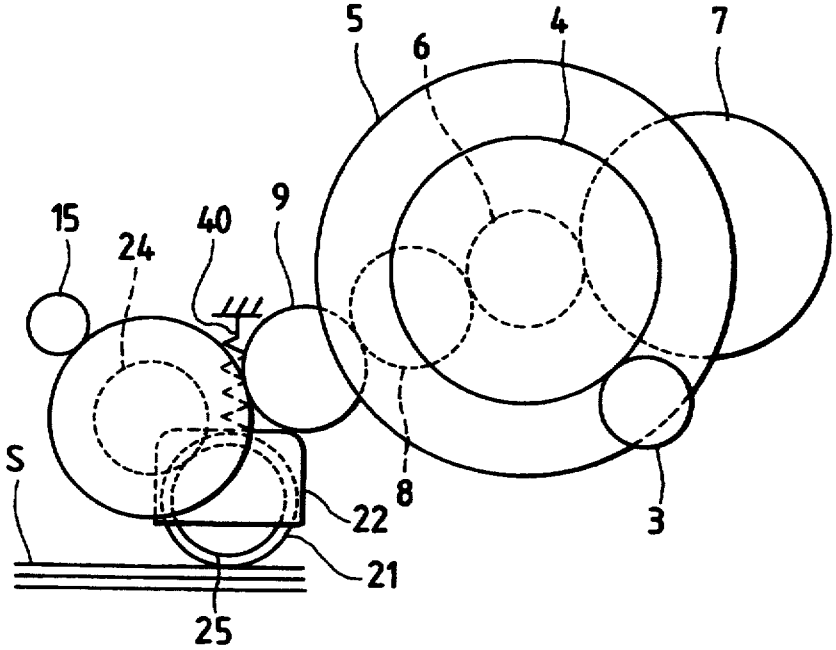
FIG. 3 is a side view showing linkages of the drove mechanism.
Figure 4:
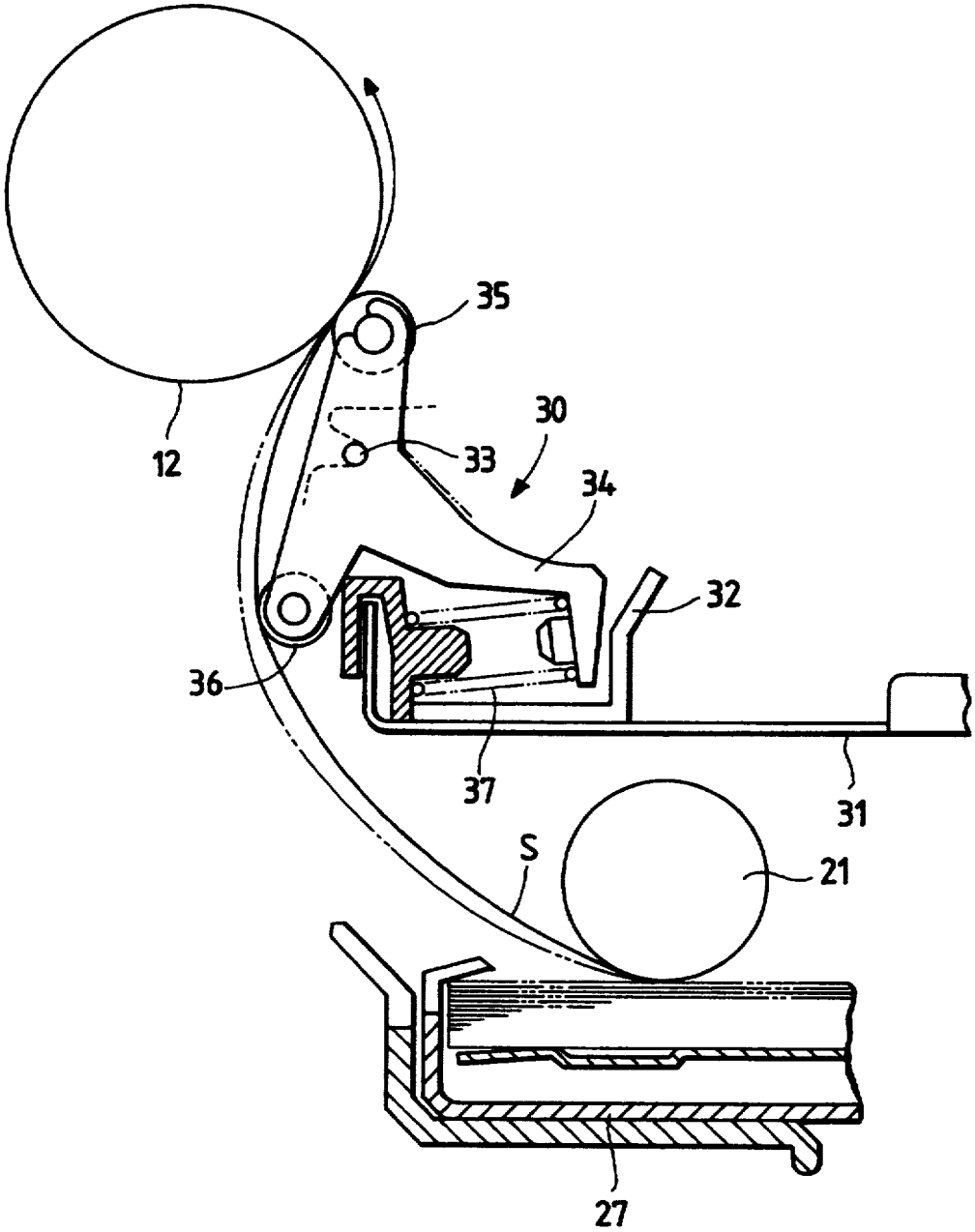
FIG. 4 is a side view showing a main portion of the apparatus in enlarged form.

FIGS. 1(*a*) to 1(*d*) show a method of straightening skew in cut sheet operation according to the present invention, and FIGS. 2 to 4 show an apparatus according to the present invention by which such method is performed.

The apparatus will be described first. Reference numeral 1 (see FIG. 2) designates a sheet feed mechanism. The sheet feed mechanism 1 includes a drive motor (not shown), a reduction gear 4, a platen gear 7, a sheet feed roller transmission gear 10 and an idler gear 15. The drive motor is controlled by a not shown control circuit (not shown) so that the motor first rotates in a forward direction in response to a sheet feed command signal, then switches the rotation in a backward direction immediately after a cut sheet s (see FIGS. 1(*a*)–1(*d*)) has been nipped, and lastly switches the rotation back in the forward direction again. The reduction gear 4 is meshed with a pinion 3 of the drive motor. Reference numeral 12 identifies a platen serving as a sheet forward roller. The platen gear 7 drives the platen 12 while meshed with a pinion 6 integrated with the reduction gear 4. The sheet feed roller transmission gear 10 is meshed with the reduction gear 4 through two intermediate gears 8, 9. The idler gear 15 is arranged on one end of a carriage 14.

Reference numeral 5 designates knurls formed over the circumference of the reduction gear 4 for manual operation from outside the printer body.

Reference numeral 20 designates a sheet feed roller unit that is operated by a sheet feed roller drive gear 11. A sheet feed roller holder 22, which holds a sheet feed holder 21, is pivotably supported on the sheet feed roller unit 20 in such a manner that the sheet feed roller holder 22 is urged toward a cut sheet "s". A sheet feed roller transmission gear 10 is rotatably supported on a large portion of a drive shaft 23 which is described below.

The sheet feed roller holder 22 is pivotably mounted on an end portion of a long drive shaft 23, which extends from the sheet feed roller drive gear 11 to the middle of the cut sheet "s" in the widthwise direction. A small radius sun gear 24 fixed to the end of the drive shaft 23 meshes a gear 25 integrated with the sheet feed roller 21. The sheet feed roller holder 22 is urged toward the cut sheet s by the force of a spring 40 (see FIG. 3) at all times.

Reference numeral 30 in FIG. 4 designates one of the sheet urging roller units disposed on both sides so as to interpose the sheet feed roller unit 20 therebetween. The sheet urging roller unit 30 includes a roller holder 32 mounted on a part of a base plate 31, and a T-shaped lever 34 engageably supported by the roller holder 32 so as to pivot through a pin 33. The pair of sheet urging units is arranged symmetrically in widthwise as shown in FIG. 1(*a*).

The sheet urging roller 35 that rotates in pressure contact with the surface of the platen 12 is journaled on the upper end of the lever 34, whereas an auxiliary sheet urging roller 36 that faces the sheet guide surface is journaled on the lower end thereof. These rollers 35, 36 are designed to guide the cut sheet s from a sheet feed cassette 27 to the platen 12 while urged by a coil spring 37 within the roller holder 32, the coil spring 37 acting on the rollers 35, 36 through the lever 34.

A series of sheet feed operations including the operation of preventing the cut sheet s from skewing using this apparatus will be described with reference to FIGS. 1(*a*) to 1(*d*) and FIG. 2.

When a sheet feed command signal is applied from the control circuit, the carriage 14 is moved toward a standby side. And then the sheet operation sets to a standby state by inserting the idler gear 15 mounted on the lateral surface of the carriage 14 into a hole (not shown) arranged on a lateral plate of a case, and by meshing the sheet feed roller transmission gear 10 with the sheet feed roller drive gear 11.

Then, when the drive motor starts rotating in the forward direction, the platen gear 7 meshed with the reduction pinion 6 causes the platen 12 integrated with the platen gear 7 to rotate in the forward direction. The sheet feed roller transmission gear 10 transmits rotation in a direction opposite to the sheet feed direction to the sheet feed roller drive gear 11 through the idler gear 15 on the carriage 14.

The sun gear 24 integrated with the sheet feed roller drive gear 11 transmits rotation in the sheet feed direction to the sheet feed roller gear 25 meshed therewith. And the sheet feed roller holder 22 mounted on the drive shaft 23 is turned to a position shown in FIG. 1(*a*) by the rotating torque derived from such rotation and the pressure of the spring 40. Thereby it causes the sheet feed roller 21 to come in contact with the cut sheet "s" in the middle of the sheet in the widthwise direction, the cut sheet "s" being accommodated in the sheet feed cassette 27. The cut sheet "s" is then fed toward the platen 12 with the rotation of the sheet feed roller 21 (FIG. 1(*a*).

As a result, the cut sheet "s" fed by the sheet feed roller 21 first has its front end detected by a sheet detecting sensor 41 disposed at a portion along the sheet feed passage, and then reaches the platen 12 that is rotating in the forward direction.

The control circuit controls the drive motor to rotate in the backward direction immediately after the front end of the cut sheet "s" has been nipped by the platen 12 based on the detection signal from the sheet detecting sensor 41. Therefore, if the sheet "s" is skew in the widthwise direction because of a certain problem during feeding, for example the cut sheet "s" is fed obliquely as shown in FIG. 1(*b*), the platen 12 rotates in the backward direction upon nipping a portion "a" of the cut sheet "s" which has reached the platen 12 first, i.e., the right front end of the cut sheet "a" as shown in FIG. 1(*b*), thereby immediately withdrawing the right front end portion "a" that has been nipped.

On the other hand, since the carriage drive motor (not shown) drives the carriage 14 to the middle of the print area through a timing belt so that the carriage 14 can serve as a paper bail, the sheet feed roller drive gear 11 and the sheet feed roller transmission gear 10 are disengaged from each other to free the sheet feed roller holder 22, thereby causing the sheet feed roller 21 to be free from rotation.

The cut sheet "s" whose right front end portion "a" has been withdrawn from the platen 12 is instantly adjusted to a correct position while turned in an arrow direction as shown in FIG. 1(*c*), and is fed toward a record head (not shown) by the platen 12 whose rotation is switched to the forward direction immediately thereafter, as shown in FIG. 1(*d*).

While the above-mentioned embodiment is designed so that the timing of the operation of switching the rotation of the platen 12 between the forward and the backward directions is controlled by the signal from the sheet detecting sensor 41, such operation may be controlled by a print start signal.

Further, by applying the skew straightening operation to sheet forward rollers other than the platen, the skew in sheets encountered by copying machines and ordinary printing machines may be effectively prevented.

As described in the foregoing, the operation according to the present invention includes reversely rotating the sheet forward roller immediately after the front end of a cut sheet is nipped. Therefore, if the cut sheet is subjected to skew feeding, the cut sheet can be turned in the sheet forward direction instantly and simultaneously with the rotation of the sheet forward roller by taking advantage of a difference between the nipping amounts on the right and the left ends of the sheet. As a result, the operation of correcting the skew of this type can be performed very quickly.

In addition, since the skew straightening operation of the invention is not based on the reaction of the sheet itself, the applicability of the invention to a variety of kinds of paper, whether hard or soft, can be widened, thus ensuring effective and reliable skew correction.

What is claimed is:

1. A method of straightening a skew in a cut sheet comprising the steps of:

rotating a sheet feed roller to feed the cut sheet toward a sheet forward roller which is rotating forwardly in a sheet forward direction;

rotating the sheet forward roller backwardly immediately after one of a right and left portion of a leading edge of the cut sheet is nipped by the sheet forward roller;

adjusting a position of the leading edge of the cut sheet in a direction orthogonal to the sheet forward direction by an amount equal to a distance measured in the sheet forward direction between the right and left portions of the leading edge of the cut sheet;

straightening the skew in the cut sheet by rotating the cut sheet while the sheet forward roller is rotated backwardly; and feeding the cut sheet by rotating the sheet forward roller forwardly again.

2. A method according to claim 1, further comprising the step of;

releasing the sheet feed roller from driving the cut sheet while the sheet forward roller is rotating backwardly.

3. A method of straightening a skew in a cut sheet comprising the steps of:

rotating a sheet feed roller to feed the cut sheet toward a sheet forward roller which is rotating forwardly in a sheet forward direction;

urging the cut sheet against the sheet forward roller by a pair of sheet urging units arranged symmetrically in a widthwise direction of the cut sheet and on a side of the cut sheet opposite the sheet forward roller;

rotating the sheet forward roller backwardly immediately after one of a right and left portion of a leading edge of the cut sheet is nipped between the sheet forward roller and the sheet urging units;

adjusting a position of the leading edge of the cut sheet in a direction orthogonal to the sheet forward direction by an amount equal to a distance measured in the sheet forward direction between the right and left portions of the leading edge of the cut sheet; and feeding the cut sheet by rotating the sheet forward roller forwardly again and urging the cut sheet toward the sheet forward roller by the sheet urging units.

4. An apparatus for straightening a skew in a cut sheet comprising:

a sheet forward roller;

a sheet feed roller for feeding the cut sheet forward to said sheet forward roller, wherein said sheet forward roller is disposed on a downstream side in a sheet forward direction of said sheet feed roller; and control means for controlling said sheet forward roller so that rotation of the sheet forward roller is switched from a forward direction to a backward direction immediately after one of a right and left portion of a leading edge of the cut sheet is nipped, and switched back to the forward direction thereafter, wherein the skew in the cut sheet is straightened by rotating the cut sheet while said sheet forward roller is rotated backwardly.

5. An apparatus according to claim 4, further comprising means for releasing said sheet feed roller from driving the cut sheet while said sheet forward roller is rotating backwardly.

6. An apparatus according to claim 4, further comprising:

a pair of sheet urging units arranged symmetrically in a widthwise direction of the cut sheet and on a side of the cut sheet opposite said sheet forward roller.

* * * * *